US006839446B2

(12) United States Patent
Blumenau

(10) Patent No.: US 6,839,446 B2
(45) **Date of Patent: *Jan. 4, 2005**

(54) HEARING AID WITH SOUND REPLAY CAPABILITY

(76) Inventor: Trevor I. Blumenau, 1800 Pacific Ave., #505, San Francisco, CA (US) 94109

( * ) Notice: Subject to any disclaimer, the term of this patent is extended or adjusted under 35 U.S.C. 154(b) by 187 days.

This patent is subject to a terminal disclaimer.

(21) Appl. No.: 10/157,750

(22) Filed: May 28, 2002

(65) Prior Publication Data

US 2003/0223605 A1 Dec. 4, 2003

(51) Int. Cl.[7] ..... H04R 25/00
(52) U.S. Cl. ..... 381/312; 381/320
(58) Field of Search ..... 381/23.1, 312, 381/320, 321, 56, 57, 58, 110, 123, 60; 73/585; 600/559

(56) References Cited

U.S. PATENT DOCUMENTS

| | | | | |
|---|---|---|---|---|
| 3,999,015 A | | 12/1976 | Snyder et al. | 179/1 |
| 5,091,952 A | | 2/1992 | Williamson et al. | 381/68.2 |
| 5,710,819 A | | 1/1998 | Topholm et al. | 381/68.2 |
| 5,721,783 A | | 2/1998 | Anderson | 381/68.6 |
| 5,867,581 A | * | 2/1999 | Obara | 381/312 |
| 5,903,227 A | | 5/1999 | Scheuer | 340/945 |
| 6,021,207 A | | 2/2000 | Puthuff et al. | 381/330 |
| 6,160,496 A | | 12/2000 | Scheuer | 340/945 |
| 6,236,731 B1 | | 5/2001 | Brennan et al. | 381/316 |
| 6,493,450 B1 | | 12/2002 | Scheuer et al. | 381/57 |

FOREIGN PATENT DOCUMENTS

JP 05-056499 3/1993

OTHER PUBLICATIONS

PMA7000B–Series Audio Selector Panel Marker Beacon Receiver and Stereo Intercom System—Pilot's Guide and Operation Manual, PS Engineering, Inc., May 2002.
PMA7000B–Series Audio Selector Panel Marker Beacon Receiver and Stereo Intercom System—Pilot's Guide and Operation Manual, PS Engineering, Inc., May 2002.
World Wide Web page describing "Car Cell Phone System with Continuous Digital Recording Hear It Again Technology," www.sharperimage.com/us/en/catalog, Nov. 8, 2001.
World Wide Web page describing "Desktp Hear It Again Continuous Digital Recorder for Telephones," www.sharperimage.com/us/en/catalog, Nov. 8, 2001.
The Sharper Image—Holiday 2001 Catalog, p. 10.
The Sharper Image—Holiday 2001 Catalog, p. 11.

* cited by examiner

*Primary Examiner*—Huyen Le
(74) *Attorney, Agent, or Firm*—David R. Graham

(57) ABSTRACT

A hearing aid includes a sound replay capability. The hearing aid can operate in a normal mode, augmenting sound as the sound occurs, or the hearing aid can operate in a replay mode (typically in response to input from the wearer of the hearing aid), replaying sound beginning up to a specified duration of time prior to the current time.

30 Claims, 5 Drawing Sheets

HEARING AID WITH SOUND REPLAY CAPABILITY

BACKGROUND OF THE INVENTION

1. Field of the Invention

This invention relates to a hearing aid and, in particular, to a hearing aid including sound replay capability.

2. Related Art

FIG. 1 is a block diagram of a conventional analog hearing aid 100. The hearing aid 100 is mounted on a wearer on, in, or proximate to an ear of the wearer to assist the wearer in hearing. The hearing aid 100 includes a microphone 101 that is adapted to sense sound in the vicinity of the hearing aid 100 (and, thus, in the vicinity of the wearer) and convert the sensed sound to electrical signals. (The hearing aid 100 could also be implemented to include a receiver instead of, or in addition to, the microphone 101, signal(s) representing sensed sound being transmitted to the receiver by one or more transmitter(s) that are typically positioned at location(s) that are not proximate to an ear of the wearer of the hearing aid 100.) The electrical signals produced by the microphone 101 (and/or received by a receiver) are input to a filter 102 which processes the electrical signals to remove undesirable artifacts. The filtered electrical signals from the filter 102 are input to an amplifier 103 which amplifies the electrical signals to produce an amplified electrical signal that is compatible (as understood by those skilled in the art) with the speaker 105 (described later). The amplified electrical signals from the amplifier 103 are input to a filter 104 which processes the amplified electrical signals to further remove undesirable artifacts. A speaker 105 receives the electrical signals from the filter 104 and produces sound in accordance with the electrical signals, thereby reproducing sound that occurs in the vicinity of the wearer. In particular, as is well understood, the hearing aid 100 reproduces sound that occurs in the vicinity of a wearer so as to facilitate hearing of that sound by the wearer. (Though the filter 102 and the filter 104 are described above as part of the hearing aid 100, those skilled in the art will understand that a conventional analog hearing aid, such as the hearing aid 100, need not necessarily include a filter such as the filter 102 and/or a filter such as the filter 104. Additionally, those skilled in the art will understand that, though the filters 102 and 104 are illustrated in FIG. 1 separate from other components of the hearing aid 100, the filter 102 can be implemented in the same apparatus as the microphone 101 (and/or receiver) or the amplifier 103, and/or the filter 104 can be implemented in the same apparatus as the amplifier 103 or the speaker 105.)

FIG. 2 is a block diagram of a conventional digital hearing aid 200. As the hearing aid 100 of FIG. 1, the hearing aid 200 is worn by a wearer to assist the wearer in hearing. The hearing aid 200 includes a microphone 201 (and/or receiver), filters 202 and 204, and a speaker 205 which provide the same or similar functionality as that described above for the microphone 101 (and/or receiver), filters 102 and 104, and speaker 105, respectively, of the hearing aid 100. (Like a conventional analog hearing aid, a conventional digital hearing aid, such as the hearing aid 200, need not necessarily include the filter 202 and/or the filter 204.) In the digital hearing aid 200, the filtered electrical signals from the filter 202 are input to an A/D converter 206 to convert the analog electrical signals produced by the microphone 201 (and/or received by a receiver) and processed by the filter

202) to digital electrical signals. The digital electrical signals from the A/D converter 206 are input to a digital processing unit 203 which processes the electrical signals, as described further below, to produce a processed electrical signal having desired characteristics and compatibility with the speaker 205. The processed electrical signals from the digital processing unit 203 are input to a D/A converter 207 to convert the digital electrical signals to analog electrical signals that can be used by the speaker 205 to produce sound. (Though not illustrated in FIG. 2, the hearing aid 200 may also include an amplifier between the D/A converter 207 and the speaker 205 to amplify the electrical signals to have a magnitude compatible with the speaker 205, as understood by those skilled in the art.)

As indicated above, the digital processing unit 203 of the hearing aid 200 processes the electrical signals. In particular, the digital processing unit 203 can be implemented to selectively process the electrical signals based on the magnitude of the electrical signals and/or the frequencies contained in the electrical signals. The digital processing unit 203 can include a digital signal processor (DSP), as known to those skilled in the art, which can be implemented to accomplish the above-described functionality of the digital processing unit 203. The digital processing unit 203 can also include other devices (e.g., a memory device) in addition to the DSP to facilitate the operations of the DSP.

Conventional hearing aids have been produced in a variety of sizes and shapes, but, as can readily be appreciated, all hearing aids must be, or preferably are, constructed to be relatively small apparatus. Until recently, manufacturing capabilities have limited the ability to include functionality in a hearing aid in addition to that described above without causing the hearing aid to be larger than is desirable for some applications and/or people. In the same vein, the small size of hearing aids necessitates the use of a relatively small power supply (e.g., battery), which has also limited the ability to include functionality in a hearing aid in addition to that described above.

SUMMARY OF THE INVENTION

According to the invention, a hearing aid includes a sound replay capability. A hearing aid according to the invention can operate in a normal mode, augmenting sound as the sound occurs, or the hearing aid can operate in a replay mode (typically in response to input from the wearer of the hearing aid), replaying sound beginning up to a specified duration of time (e.g., 5 seconds, 10 seconds or 30 seconds) prior to the current time. The invention can be implemented in both analog and digital hearing aids. The invention takes advantage of recent advances in manufacturing processes for electronic devices (e.g., development of integrated circuit fabrication processes enabling production of devices having increased density of electrical components and/or lower power consumption) to provide a sound replay capability in a hearing aid that heretofore may not have been possible or feasible. Additionally, the invention can be implemented so that a conventional hearing aid can be easily modified to produce a hearing aid according to the invention having sound replay capability (e.g., an integrated circuit implementing the sound replay capability can be inserted at an appropriate location in the circuitry used to implement a conventional hearing aid).

In one embodiment of the invention, a hearing aid includes sound reproduction apparatus adapted to be mounted on a wearer on, in, or proximate to an ear of the wearer, the sound reproduction apparatus including: 1)

sound data acquisition apparatus, 2) sound production apparatus, and 3) sound replay apparatus. The sound data acquisition apparatus can sense sound in the vicinity of the hearing aid and convert the sensed sound to a signal representing current sound data, and/or the sound data acquisition apparatus can receive a signal representing current sound data that is transmitted by a transmitter. The sound production apparatus is adapted to produce sound in accordance with sound data acquired by the sound data acquisition apparatus. The sound replay apparatus is adapted to enable replay of sound represented by sound data acquired by the sound data acquisition apparatus. The sound replay apparatus includes a sound data accumulation device for accumulating replay sound data representing sound occurring during a replay time (i.e., a specified duration of time immediately preceding the current time), and a sound data selection device for selecting either the current sound data or the replay sound data to be transmitted to the sound production apparatus for use in producing sound.

A hearing aid according to the above-described embodiment of the invention can further include a mode selection device for enabling the wearer of the hearing aid to provide one or more replay control signals to the sound replay apparatus to cause the sound data selection device to select one of the current sound data or the replay sound data for transmission to the sound production apparatus. The mode selection device can be implemented using a pushbutton mechanism. The hearing aid can be implemented so that the sound reproduction apparatus and mode selection device are formed as an integral unit. Alternatively, the hearing aid can be implemented so that the mode selection device is separate from the sound reproduction apparatus. In the latter case, the hearing aid can be implemented to enable wireless communication between the sound reproduction apparatus and the mode selection device.

A hearing aid according to the above-described embodiment of the invention can further include a replay duration specification device for enabling the wearer of the hearing aid to provide one or more replay duration control signals to the sound replay apparatus that establish the replay time. Further, the invention can be implemented so that data representing replay duration control signal(s) can be acquired via a computer network or a telephone network.

The sound data accumulation device can be implemented using a multiplicity of sets of an amplifier, a first switch, a capacitor and a second switch arranged in series in that order, and a mechanism for controlling the first and second switches of each set. The first switches and the second switches are alternately opened and closed, 180 degrees out of phase with respect to each other, at a specified frequency. The first and second switches can be implemented using N-channel and P-channel transistors, respectively. Such a sound data accumulation device can be implemented to provide a single control signal to all of the first and second switches to effect operation of the switches. The specified frequency can be, for example, greater than or equal to about 8 kHz, or greater than or equal to about 40 kHz (the frequency used can depend on a desired fidelity of the hearing aid).

The sound replay apparatus of a hearing aid according to the above-described embodiment of the invention can further include a second sound data selection device for selecting either the current sound data or the replay sound data to be transmitted to the sound data accumulation device for accumulation by the sound data accumulation device, the first and second sound data selection devices operating synchronously such that either current sound data is sent to both of the sound production apparatus and the sound data accumulation device, or replay sound data is sent to both of the sound production apparatus and the sound data accumulation device. This enables the sound corresponding to the replay sound data to be played repetitively.

The sound replay apparatus of a hearing aid according to the above-described embodiment of the invention can further include a mechanism for processing the replay sound data so that the sound production apparatus produces sound corresponding to the replay sound data at a different rate than that at which the sound corresponding to the replay sound data actually occurred. Such a mechanism can be used to speed up the sound replay.

In another embodiment of the invention, a method includes the steps of: 1) acquiring current sound data; 2) producing sound in accordance with sound data; 3) accumulating replay sound data representing sound occurring during a replay time; and 4) selecting either the current sound data or the replay sound data to be used in producing sound.

In yet another embodiment of the invention, a hearing aid can acquire current sound data, produce sound in accordance with sound data, accumulate replay sound data representing sound, occurring during a replay time, and select either the current sound data or the replay sound data to be used in producing sound.

DETAILED DESCRIPTION OF THE INVENTION

According to the invention, a hearing aid includes a sound replay capability (i.e., the capability of producing sound in accordance with sound data representing sound that occurred prior to sound represented by the sound data most recently acquired by the hearing aid). In a normal mode of operation, a hearing aid according to the invention augments sound as the sound occurs, as a conventional hearing aid. In a replay mode of operation, a hearing aid according to the invention replays sound beginning up to a specified duration of time (such as, for example, 5 seconds, 10 seconds or 30 seconds) prior to the current time (herein, such specified duration of time is sometimes referred to as the "replay time"). (The replayed sound may begin at less than the specified duration of time prior to the current time if, for example, the hearing aid was not operating at the specified duration of time prior to the current time, e.g., if a hearing aid that can replay up to 10 seconds of sound has been operating for only 5 seconds.)

A hearing aid according to the invention is adapted to be "worn" by a "wearer" to assist the wearer in hearing. Herein, a "wearer" of a hearing aid according to the invention is any sentient being capable of hearing. It is anticipated that, typically, a "wearer" of a hearing aid according to the invention will be a person; however, a "wearer" of a hearing aid according to the invention can also be an animal. Further, herein, a hearing aid according to the invention is "worn" when the hearing aid is mounted on a wearer in a manner that enables the hearing aid to facilitate hearing of the wearer of the hearing aid. For example, it is anticipated that, typically, the sound reproduction apparatus (see FIG. 3 and associated description below) of a hearing aid according to the invention will be mounted on the wearer on, in, or proximate to an ear of the wearer.

Figure 3:
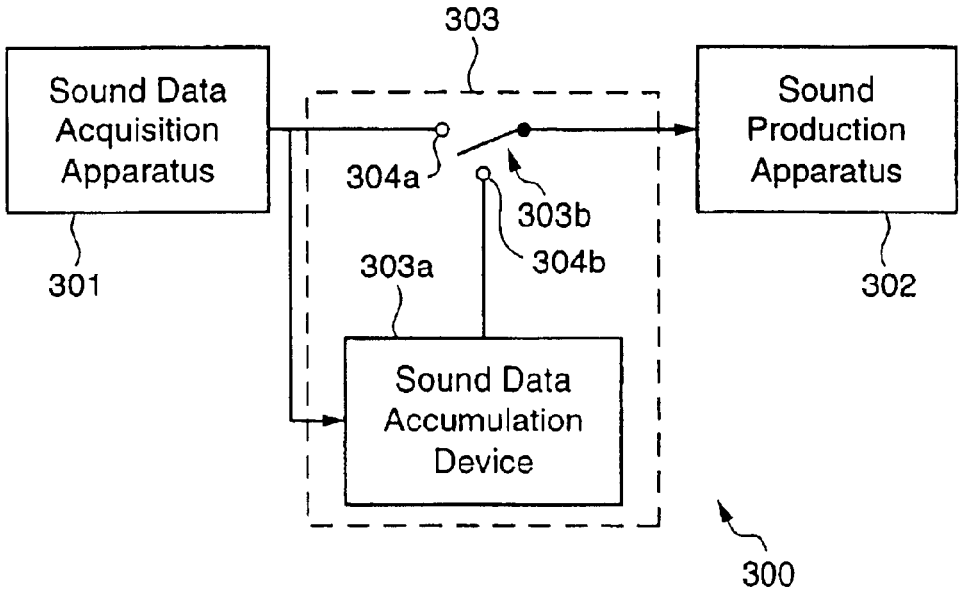
FIG. 3 is a block diagram of a hearing aid according to the invention.

FIG. 3 is a block diagram of a hearing aid 300 according to the invention. The hearing aid 300 includes a sound data acquisition apparatus 301, a sound production apparatus 302 and a sound replay apparatus 303.

The sound data acquisition apparatus 301 is adapted to acquire sound data representing sound that it is desired to augment using the hearing aid 300. The sound data acquired by the sound data acquisition apparatus 301 at each current time is sometimes referred to herein as "current sound data." The sound data can be represented in any appropriate manner: the type of representation of the sound data will depend upon the device(s) used to implement the sound data acquisition apparatus 301. For example, it is anticipated that, typically, as is the case for conventional hearing aids, a hearing aid according to the invention (and, in particular, the sound data acquisition apparatus) will be implemented as an electronic device in which the sound data is represented by electrical signals. However, the invention also contemplates embodiments of a hearing aid according to the invention in which the sound data is represented in other ways. The sound data acquisition apparatus 301 can be implemented using sound sensing apparatus that is adapted to sense sound in the vicinity of the hearing aid 300 and convert the sensed sound to sound data (e.g., electrical signals representing sound data). Sound sensing apparatus for use in a hearing aid according to the invention can be implemented using any appropriate device(s) that accomplish the functionality of the sound sensing apparatus, such as any microphone conventionally used in a hearing aid. The sound data acquisition apparatus 301 can also be implemented using—in addition to, or instead of, sound sensing apparatus—a receiver that receives signal(s) representing sensed sound that are transmitted by one or more transmitter(s). Each transmitter obtains sound data from sound sensing apparatus associated with the transmitter and is typically positioned at a location that is not proximate to an ear of the wearer of the hearing aid.

The sound production apparatus 302 is adapted to produce sound in accordance with sound data acquired by the sound data acquisition apparatus. As described further below, in accordance with the invention, the sound data received by the sound production apparatus 302 can be either current sound data or replay sound data, the latter enabling replaying of sound represented by sound data acquired by the hearing aid 300. The sound production apparatus 302 can be implemented using any appropriate device(s) that accomplish the functionality of the sound production apparatus 302, e.g., any speaker as conventionally used in a hearing aid.

The sound replay apparatus 303 is adapted, as described in more detail below, to enable replay of sound represented by sound data acquired by the hearing aid 300. The sound replay apparatus 303 includes a sound data accumulation device 303*a* and a sound data selection device 303*b*. The sound data accumulation device 303*a* is adapted to enable accumulation of sound data (sometimes referred to herein as "replay sound data") representing sound occurring for up to a specified duration of time immediately preceding the current time. Exemplary implementations of the sound data accumulation device 303*a* are described further below. The sound data selection device 303*b* is adapted to enable selection of either the current sound data (the sound data selection device 303*b* contacts terminal 304*a*) or the replay sound data (the sound data selection device 303*b* contacts terminal 304*b*) to be transmitted to the sound production apparatus 302 for use in producing sound. The sound data selection device 303*b* can be implemented using, for example, a transistor or a multiplexer.

Figure 1:
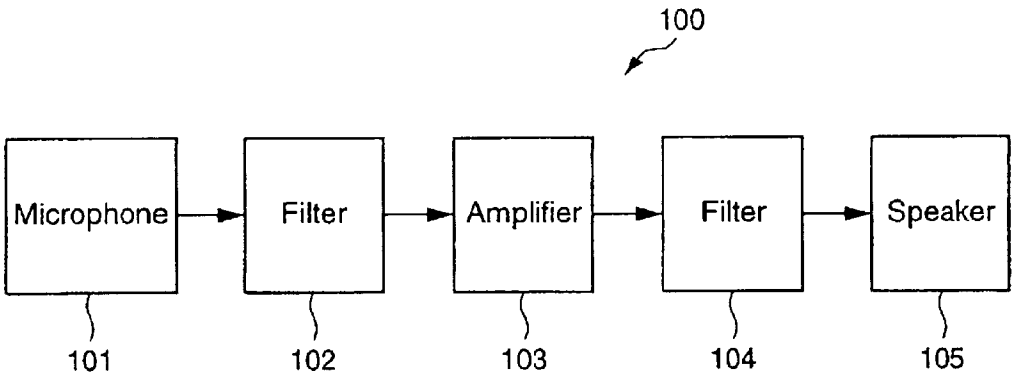
FIG. 1 (Prior Art)
FIG. 1 is a block diagram of a conventional analog hearing aid.
Figure 2:
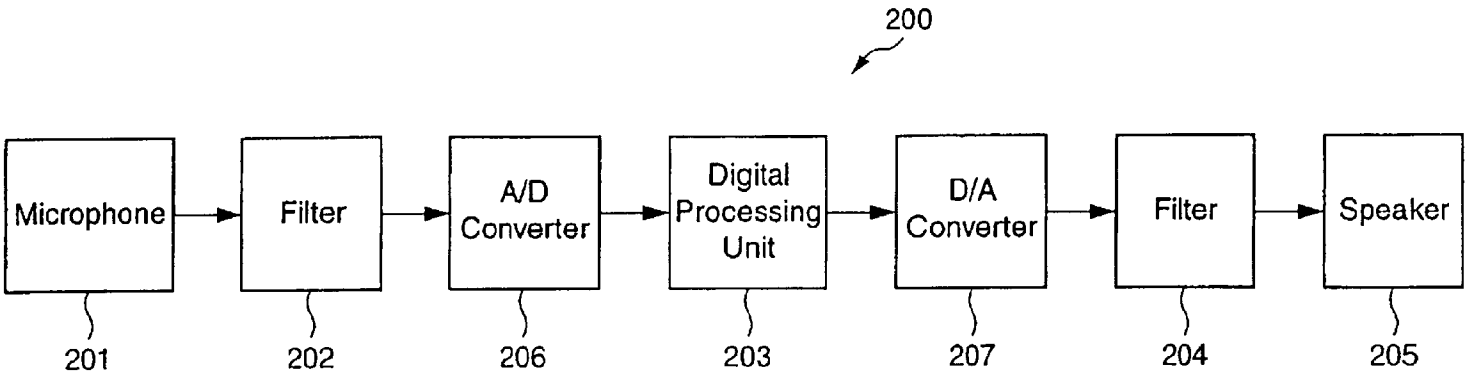
FIG. 2 (Prior Art)
FIG. 2 is a block diagram of a conventional digital hearing aid.

The invention can advantageously be implemented so that the sound data accumulation device 303*a* and the sound data selection device 303*b* of the sound replay apparatus 303 are constructed together as a single integrated apparatus (e.g., as part of a single integrated circuit). Using such an implementation, a conventional hearing aid can be easily modified to produce a hearing aid according to the invention (compare FIGS. 4 and 5, described below, to FIGS. 1 and 2, respectively, described above). For example, an integrated circuit implementing the sound replay apparatus 303 of a hearing aid according to the invention can simply be inserted at an appropriate location in the circuitry used to implement a conventional hearing aid.

Typically, a hearing aid according to the invention will be implemented so that a user input apparatus (not illustrated in FIG. 3) controlled by the wearer of the hearing aid can be used to specify one or more control signals ("replay control signal(s)") that control whether the sound data selection device 303*b* selects the current sound data or the replay sound data to be transmitted to the sound production apparatus 302. (Herein, such a user input apparatus is sometimes referred to as a "mode selection device.") The mode selection device can be implemented using any of a variety of devices or mechanisms. For example, the mode selection device can be implemented using a pushbutton mechanism. The mode selection device can be formed as part of the sound reproduction apparatus (i.e., the sound data acquisition apparatus 301, sound production apparatus 302 and sound replay apparatus 303 of FIG. 3) of the hearing aid or the mode selection device can be implemented as a device that is separate from the sound reproduction apparatus of the hearing aid. In the latter case, the sound reproduction apparatus of the hearing aid and the mode selection device can advantageously be implemented to enable wireless communication therebetween. Wired communication between the sound reproduction apparatus of the hearing aid and the mode selection device can also be used. Additionally, the invention can be implemented so that a single mode selection device can be used to control multiple hearing aids according to the invention (e.g., a hearing aid on each ear of a wearer).

A hearing aid according to the invention can be implemented so that a mode selection device can be operated in any of a variety of ways to select the mode of operation of the hearing aid. For example, a hearing aid according to the invention can be implemented to always operate in normal mode unless, and as long as, a control signal is received from a mode selection device (e.g., the hearing aid operates in normal mode unless a pushbutton mechanism is being depressed, in which case the hearing aid operates in replay mode). Or, for example, a hearing aid according to the invention can be implemented to operate in normal mode when the hearing aid is turned on, and to switch between modes each time that a control signal is subsequently received from a mode selection device (e.g., a pushbutton mechanism must be depressed to change from normal mode to replay mode and vice versa, but need not continue to be depressed to remain in the selected mode). Or, for example, a hearing aid according to the invention can be implemented to operate so that each of the normal and replay modes of operation can only be selected by specifying a particular control signal or set of control signals (e.g., each of normal mode and replay mode can only be selected by depressing a pushbutton mechanism a corresponding number of times and/or depressing the pushbutton mechanism for a specified duration of time).

A hearing aid according to the invention can also be implemented so that a user input apparatus (not illustrated in FIG. 3) controlled by the wearer of the hearing aid can be used to specify one or more control signals ("replay duration control signal(s)") that establish the amount of replay time, i.e., that establish the duration of time prior to a current time from which sound can be replayed. (Herein, such a user input apparatus is sometimes referred to as a "replay duration specification device.") The replay duration control signal(s) can specify a particular amount of replay time by, for example, specifying the frequency of operation (i.e., switching) of a signal delay device used in implementation of the sound data accumulation device 303*a* (see FIGS. 4–7 and associated description below) and can be input to, and stored on, a data storage device of the sound data accumulation device 303*a* (if necessary or desirable). The replay duration specification device can be implemented using any of a variety of appropriate apparatus and can be operated in any of a variety of ways to specify the amount of replay time. For example, the replay duration specification device can be implemented by apparatus that is similar to apparatus currently used with some digital hearing aids to input new instructions to the digital processing unit of the hearing aid to effect particular processing (as discussed above with respect to FIG. 2) of the sound data. The replay duration specification device can be implemented as part of, or separate from, the mode selection device and/or the sound reproduction apparatus of a hearing aid according to the invention. In the latter case, the replay duration specification device can communicate with the mode selection device and/or the sound reproduction apparatus using wireless or wired communication methods and apparatus. A hearing aid according to the invention can also be implemented so that data representing replay duration control signal(s) can be acquired by a replay duration specification device via a computer network (e.g., the Internet) or a telephone network (e.g., conventional telephone network, cellular telephone network).

Figure 4:
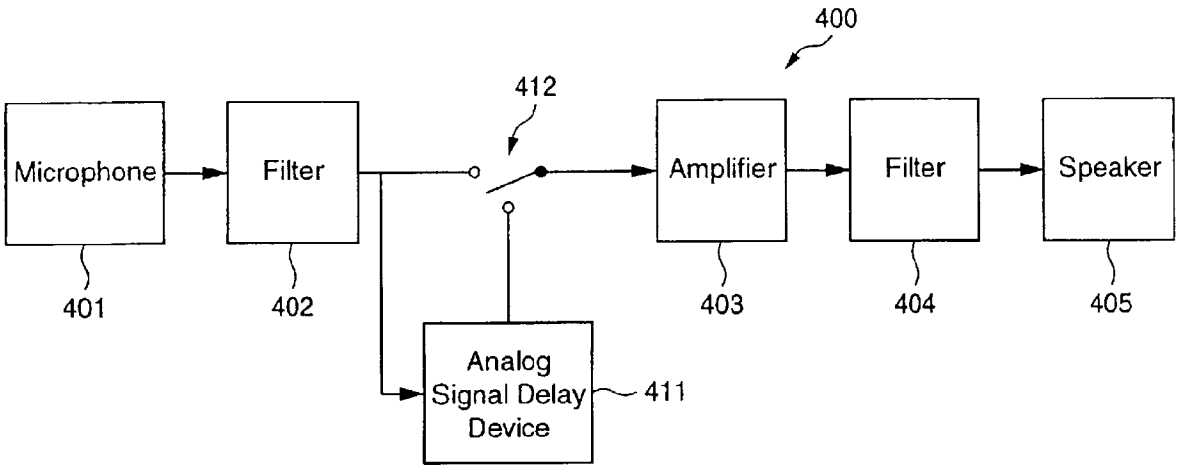
FIG. 4 is a block diagram of an analog hearing aid according to an embodiment of the invention.

FIG. 4 is a block diagram of an analog hearing aid 400 according to the invention. The hearing aid 400 includes a microphone 401, filter 402, amplifier 403, filter 404 and speaker 405 that can be constructed and operate in the same or similar manner as the microphone 101, filter 102, amplifier 103, filter 104 and speaker 105, respectively, of the conventional analog hearing aid 100 described above (FIG. 1). (Like the hearing aid 100, the hearing aid 400 can also be implemented to include a receiver instead of, or in addition to, the microphone 401, signal(s) representing sensed sound being transmitted to the receiver by one or more transmitter(s) that are typically positioned at location (s) that are not proximate to an ear of the wearer of the hearing aid.) The microphone 401, filter 402, amplifier 403, filter 404 and speaker 405 can be embodied by, for example, any apparatus used in conventional analog hearing aids. The hearing aid 400 also includes analog signal delay device 411 and sound data selection device 412, which together comprise a sound replay apparatus. In general, the analog signal delay device 411 and the sound data selection device 412 can be embodied by any apparatus that accomplishes the functions of the analog signal delay device 411 and the sound data selection device 412 as described herein, as can be understood by those skilled in the art in view of the description herein. A particular way of implementing the analog signal delay device 411 is described below with respect to FIG. 6.

During use of the hearing aid 400, the sound data selection device 412 is engaged, in response to appropriate input, to cause sound data to be transmitted to the amplifier 403 (and, eventually, to the speaker 405) either directly from the Microphone 401 (and filter 402) or through the analog signal delay device 411. In the former case, the hearing aid 400 operates in the manner of a normal analog hearing aid, augmenting sound as the sound occurs. In the latter case, the hearing aid 400 operates in a replay mode in accordance with the invention, replaying sound during a replay time.

Figure 5:
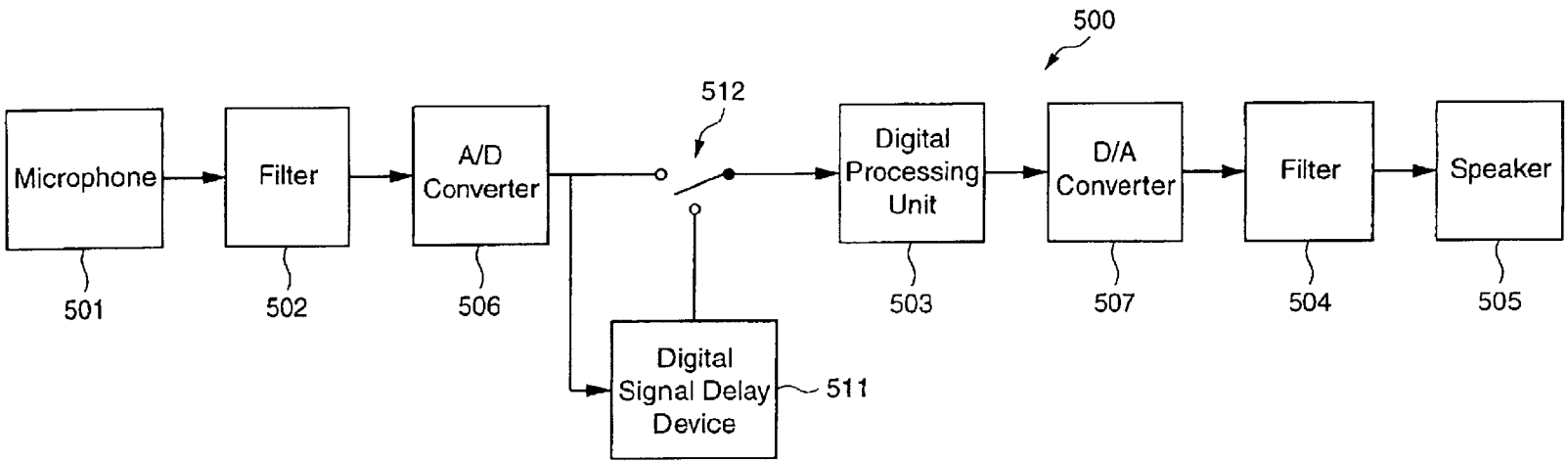
FIG. 5 is a block diagram of a digital hearing aid according to an embodiment of the invention.

FIG. 5 is a block diagram of a digital hearing aid 500 according to the invention. The hearing aid 500 includes a microphone 501, filter 502, digital processing unit 503, filter 504, speaker 505, A/D converter 506 and D/A converter 507 that can be constructed and operate in the same or similar manner as the microphone 201, filter 202, digital processing unit 203, filter 204, speaker 205, A/D converter 206 and D/A converter 207, respectively, of the conventional digital hearing aid 200 described above (FIG. 2). (Like the hearing aid 200, the hearing aid 500 can also be implemented to include a receiver instead of, or in addition to, the microphone 501, signal(s) representing sensed sound being transmitted to the receiver by one or more transmitter(s) that are typically positioned at location(s) that are not proximate to an ear of the wearer of the hearing aid a receiver.) The microphone 501, filter 502, digital processing unit 503, filter 504, speaker 505, A/D converter 506 and D/A converter 507 can be embodied by any apparatus used in conventional digital hearing aids. The hearing aid 500 also includes digital signal delay device 511 and sound data selection device 512, which together comprise a sound replay apparatus. In general, the digital signal delay device 511 and the sound data selection device 512 can be embodied by any apparatus that accomplishes the functions of the digital signal delay device 511 and the sound data selection device 512 as described herein, as can be understood by those skilled in the art in view of the description herein. A particular way of implementing the digital signal delay device 511 is described below with respect to FIG. 7.

The hearing aid 500 operates in a manner similar to that of the hearing aid 400 described above. During use of the hearing aid 500, the sound data selection device 512 is engaged, in response to appropriate input, to cause sound data to be transmitted to the digital processing unit 503 (and, eventually, to the speaker 507) either directly from the microphone 501 (and filter 502 and A/D converter 506) or through the digital signal delay device 511. In the former case, the hearing aid 500 operates in the manner of a normal digital hearing aid, augmenting sound as the sound occurs. In the latter case, the hearing aid 500 operates in a replay mode in accordance with the invention, replaying sound during a replay time.

Though the filters 402 and 404 and the filters 502 and 504 are described above as part of the hearing aids 400 and 500, respectively, either or both of those filters can be eliminated from the hearing aid 400 or the hearing aid 500. Further, the hearing aid 500 can include a filter between components of the hearing aid 500 other than as illustrated in FIG. 5.

Additionally, the hearing aids 400 and 500 can include other components not illustrated in FIGS. 4 and 5 that may be necessary or desirable to effect the functionality of the hearing aid 400 or 500. For example, the hearing aid 500 can include an amplifier between the D/A converter 507 and the speaker 505; since the strength of the electrical signal produced by the D/A converter 507 is often smaller than is desirable for input to the speaker 505, such an amplifier may be necessary or desirable.

Further, the signal delay device and sound data selection device in the hearing aids 400 and 500 can be located other than as shown in FIGS. 4 and 5. For example, the analog signal delay device 411 and sound data selection device 412 can be positioned between the amplifier 403 and the speaker 405. Or, for example, the digital signal delay device 511 and sound data selection device 512 can be positioned between the digital processing unit 503 and the D/A converter 507. Generally, the sound replay apparatus (e.g., signal delay device and sound data selection device) of a hearing aid according to the invention can be situated at any location among the components of a conventional hearing aid that enables the functionality of the sound replay apparatus to be effected.

Figure 6:
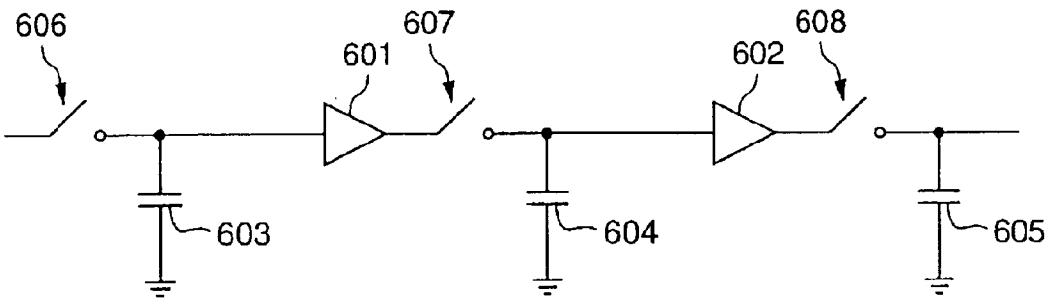
FIG. 6 is a schematic diagram illustrating an embodiment of a signal delay device that can be used in a hearing aid according to the invention.
Figure 7:
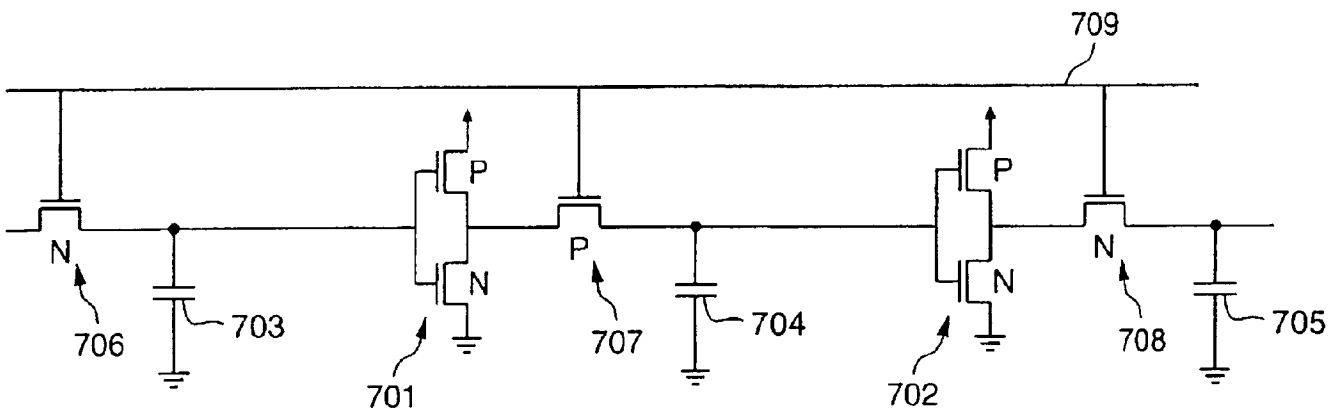
FIG. 7 is a schematic diagram illustrating a digital signal delay device, in accordance with the embodiment illustrated in FIG. 6, that can be used in a digital hearing aid according to the invention.

A signal delay device for use in the hearing aid 400 or the hearing aid 500 can be constructed as an alternating series of amplifiers (or buffers) and capacitors, with a switch located between each adjacent capacitor and amplifier (or buffer). FIG. 6 is a schematic diagram illustrating such an embodiment of a signal delay device, known to those skilled in the art as a "bucket brigade device." FIG. 7 is a schematic diagram illustrating a digital signal delay device, in accordance with the embodiment illustrated in FIG. 6, that can be used in a digital hearing aid according to the invention. For simplicity, only amplifiers 601 and 602, capacitors 603, 604 and 605, and switches 606, 607 and 608 of the signal delay device are shown in FIG. 6, and only inverting amplifiers 701 and 702, capacitors 703, 704 and 705, and switches 706, 707 and 708 of the digital signal delay device are shown in FIG. 7. As will be made clearer by the further description below, to enable accumulation of sound data for an adequate duration of time, the signal delay devices shown in FIGS. 6 and 7 include many more amplifiers (or buffers), capacitors and switches than those shown in FIGS. 6 and 7.

In the signal delay devices illustrated in FIGS. 6 and 7, each of the switches are alternately opened and closed at a specified frequency. Adjacent switches are opened and closed 180 degrees out of phase with respect to each other, e.g., in the signal delay device illustrated in FIG. 6, when switches 606 and 608 are open, switch 607 is closed, and vice versa. (Operation of the switches in the signal delay devices of FIGS. 6 and 7 can be effected using one or more control signals. In FIG. 7, for example, the switches are constructed so that a single switch control signal transmitted along the control signal line 709 effects the desired operation of the switches. The control signal is not illustrated in FIG. 6.) When the switches 606 and 608 are closed and the switch 607 is open, the capacitors 603 and 605 accumulate charge. When the switches 606 and 608 are open and the switch 607 is closed, the capacitor 604 accumulates charge. Thus, for each change in state of the switches, an electrical signal is advanced from one capacitor to the next. Consequently, sound data represented by electrical signals traveling through the series of amplifiers (or buffers), capacitors and switches is delayed by an amount of time equal to the number of sets of amplifier (or buffer), capacitor and switch divided by twice the switching frequency.

The following illustrates how a signal delay device as illustrated in FIG. 6 or FIG. 7 can be constructed for use in a hearing aid according to the invention. Voice sounds include frequencies between about 100 hertz to about 4 kilohertz. To adequately sample voice sounds, the sample rate should be at least twice as great as the frequency of the voice sounds being sampled. Thus, to obtain adequate sampling of the highest frequency voice sounds, a hearing aid should obtain sound data at a rate of at least about 8 kilohertz. The switching frequency of the switches of the signal delay device must be at least as great as the rate at which sound data is acquired by the hearing aid. Thus, to enable a replay of the last five seconds of sound prior to a current time, the signal delay device of FIG. 6 must include 80,000 sets of amplifier (or buffer), capacitor and switch (i.e., 80,000 amplifiers/buffers, 80,000 capacitors, 80,000 switches). In the digital signal delay device of FIG. 7, the number of required components is further affected by the number of bits used to represent each piece of sound data, since each bit is represented by a separate electrical signal. If, for example, 8-bit digital signals are used, enabling replay of the last five seconds of sound prior to a current time requires 1,920,000 transistors and 640,000 capacitors (a switching frequency of 8000 hz, 5 seconds of sound data accumulation, 8 bits for each piece of sound data, 3 transistors and 1 capacitor for delaying one bit of a piece of sound data). If it is desired to obtain sound data including even higher frequency content (e.g., to accurately reproduce some musical sounds), the number of required electrical components is even greater. For example, a "high fidelity" digital hearing aid according to the invention may be intended to obtain sound data including frequencies up to 20 kilohertz. The hearing aid sample rate and the switching frequency of the switches of the signal delay device should therefore be at least about 40 kilohertz. Accumulation of 5 seconds of sound data in such a digital hearing aid according to the invention (using 8 bit digital signals) requires 9,600,000 transistors and 3,200,000 capacitors. Similarly, if digital signals including a greater number of bits are used, the number of required electrical components increases, e.g., the use of 16 bit digital signals doubles the number of electrical components required as compared to the number required when 8 bit digital signals are used. Finally, accumulation of replay sound data for a replay time of greater than 5 seconds will also increase the required number of electrical components in the signal delay device, the number increasing in direct proportion to the increase in replay time.

Figure 8:
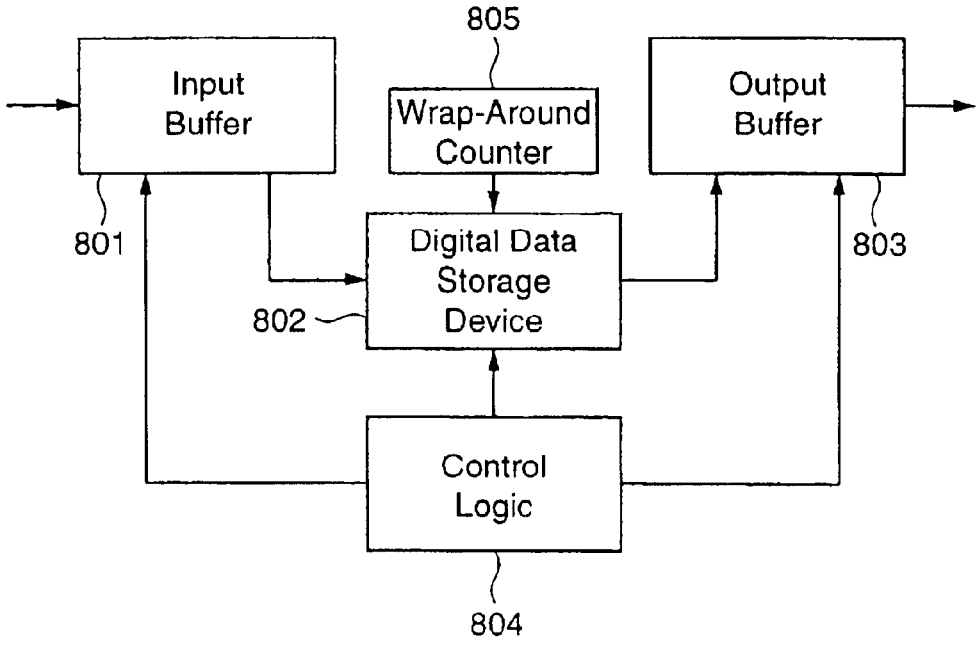
FIG. 8 is a schematic diagram illustrating another embodiment of a digital signal delay device that can be used in a digital hearing aid according to the invention.

FIG. 8 is a schematic diagram illustrating another embodiment of a digital signal delay device that can be used in a digital hearing aid according to the invention (e.g., can be used to implement the digital signal delay device 511 of the hearing aid 500 of FIG. 5). The digital signal delay device according to this embodiment includes an input buffer 801, a digital data storage device 802, an output buffer 803, control logic 804 and a wrap-around counter 805. As sound data is acquired by a sound data acquisition apparatus of the hearing aid according to the invention, the sound data is input to the input buffer 801. Under control of the control logic 804, sound data is output from the input buffer 801 and input to the digital data storage device 802. When the digital data storage device 802 stores an amount of sound data that corresponds to a specified replay time, at the time of inputting new sound data into the digital data storage device, the control logic 804 causes the sound data that has been stored longest in the digital data storage device 802 to be output from the digital data storage device 802 and input to the output buffer 803. The wrap-around counter 805 keeps track of the data storage location in the digital data storage device 802 to which new sound data should be stored and from which, if applicable, previously stored sound data should be read. If a replay control signal has been specified that causes replay sound data to be provided to the sound production apparatus of the hearing aid, then the sound data is output from the output buffer 803 for use by the sound production apparatus. Otherwise, the sound data stored in the output buffer 803 is replaced by the next sound data output from the digital data storage device 802. Each of the input buffer 801, digital data storage device 802, output buffer 803, control logic 804 and wrap-around counter 805 can be implemented using conventional apparatus, as known to those skilled in the art, in a manner that will be understood by those skilled in the art in view of the description herein. In particular, the digital data storage device can be implemented using random access memory (RAM). Either SRAM or DRAM can be used. Increasingly high density RAM has been developed in recent years and the invention can advantageously make use of such high-density RAM to enable construction of a digital signal delay device having sufficient data storage capacity to store an amount of replay sound data that enables an adequately long replay time and that is sufficiently small to be used in a hearing aid. Further, as understood by those skilled in the art, the digital data storage device 802 can be implemented using multiple data storage devices. For example, when each piece of sound data is represented by multiple bits (e.g., 8 or 16 bits), a piece of sound data can be stored by simultaneously inputting one or more of the bits of the piece of sound data into each of multiple data storage devices.

As discussed above, all hearing aids must be, or preferably are, constructed to be relatively small apparatus. As can be appreciated from the example above, until recently, manufacturing processes for electronic devices (e.g., integrated circuit fabrication processes) have not enabled the construction of a signal delay device that can both accumulate an appreciable amount of replay sound data (e.g., several seconds) and be made sufficiently small for use in a hearing aid. Additionally, the development of "denser" batteries (i.e., batteries that store more energy per unit volume) has enabled the manufacture of batteries that supply adequate power to operate sound replay apparatus in accordance with the invention, yet are sufficiently small to be used in a hearing aid. Thus, until recently, construction of a hearing aid according to the invention that includes sound replay capability may not have been possible or feasible. Advances in technology, as described above, have, in particular, enabled construction of a signal delay device that is small enough for a hearing aid and can accumulate a sufficient amount of sound data to allow an adequately long replay time and production of a sound display of adequate fidelity (i.e., by enabling sufficiently large sample rates and/or high bit data representations).

Figure 9:
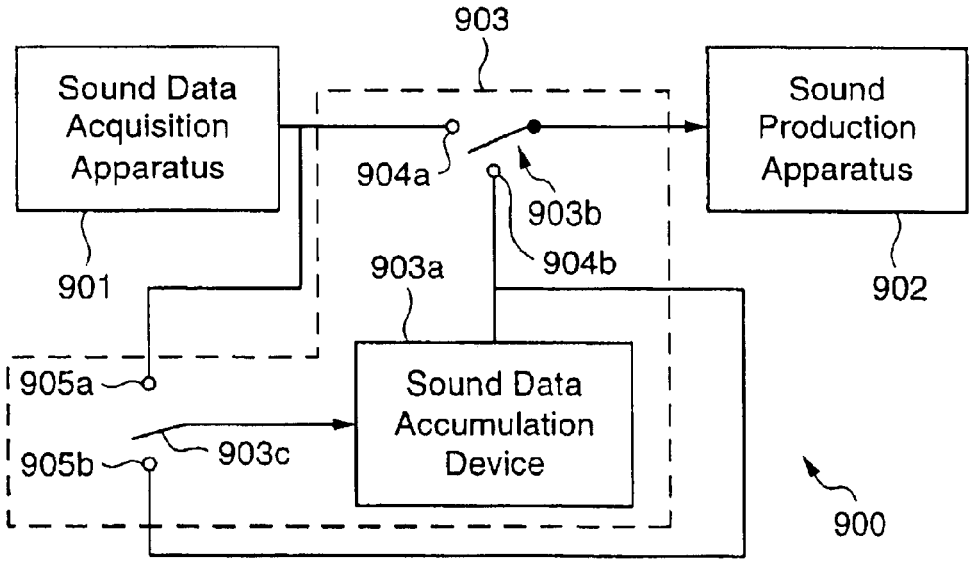
FIG. 9 is a block diagram of a hearing aid according to another embodiment of the invention.

FIG. 9 is a block diagram of a hearing aid 900 according to another embodiment of the invention. The hearing aid 900 includes a sound data acquisition apparatus 901, a sound production apparatus 902 and a sound replay apparatus 903. The sound data acquisition apparatus 901 and sound production apparatus 902 can be constructed and operate in the same or similar manner as the sound data acquisition apparatus 301 and sound production apparatus 302 of a hearing aid according to the invention described above with respect to FIG. 3. Additionally, the sound data accumulation device 903*a* and sound data selection device 903*b* of the sound replay apparatus 903 can be constructed and operate in the same or similar manner as the sound data accumulation device 303*a* and sound data selection device 303*b* of the sound replay apparatus 303 of a hearing aid according to the invention described with respect to FIG. 3. However, in addition to the sound data accumulation device 903*a* and sound data selection device 903*b*, the sound replay apparatus 903 includes a sound data selection device 903*c* that is positioned before the input to the sound data accumulation device 903*a*. During operation of the hearing aid 900 in normal mode (i.e., when the sound data selection device 903*b* is in contact with the terminal 904*a* to cause current sound data to be transmitted from the sound data acquisition apparatus 901 to the sound production apparatus 902), the sound data selection device 903*c* is in contact with terminal 905*a* so that the most recently acquired sound data (the current sound data) is continually input from the sound data acquisition apparatus 901 into the sound data accumulation device 903*a* to become potential replay sound data. During operation of the hearing aid 900 in replay mode (i.e., when the sound data selection device 903*b* is in contact with the terminal 904*b* to cause replay sound data to be transmitted from the sound data accumulation device 903*a* to the sound production apparatus 902), the sound data selection device 903*c* is in contact with terminal 905*b* to cause replay sound data transmitted from the sound data accumulation device 903*a* to be input back into the sound data accumulation device 903*a*, thus enabling the replay sound data existing at the time of beginning operation of the hearing aid 900 in replay mode to be successively replayed multiple times. In the hearing aid 900, sound produced from the replay sound data is repeated until operation of the hearing aid 900 is switched from replay mode to normal mode.

A hearing aid according to the invention can also be implemented to enable sound to be generated from the replay sound data at a different rate than that at which the sound actually occurred (e.g., the sound in replay mode can be speeded up). This can be done using known techniques for speeding up an audio display and/or removing periods of silence from an audio display, which techniques can be implemented in a hearing aid according to the invention by those skilled in the art. This may be desirable, for example, to enable the wearer of the hearing aid to more quickly review the sound represented by the replay sound data, so as to reduce the time that the wearer's attention is diverted by such replay.

Various embodiments of the invention have been described. The descriptions are intended to be illustrative, not limitative. Thus, it will be apparent to one skilled in the art that certain modifications may be made to the invention as described herein without departing from the scope of the claims set out below.

I claim:

1. A hearing aid comprising sound reproduction apparatus adapted to be mounted on a wearer on, in, or proximate to an ear of the wearer, the sound reproduction apparatus comprising:

sound data acquisition apparatus adapted to acquire current sound data representing sound that occurs in the vicinity of the hearing aid;

sound production apparatus adapted to produce sound in accordance with sound data acquired by the sound data acquisition apparatus; and sound replay apparatus, the sound replay apparatus comprising:

a sound data accumulation device for accumulating replay sound data representing sound occurring during a replay time; and a sound data selection device for selecting either the current sound data or the replay sound data to be transmitted to the sound production apparatus for use in producing sound.

2. A hearing aid as in claim 1, further comprising a mode selection device for enabling the wearer of the hearing aid to provide one or more replay control signals to the sound replay apparatus to cause the sound data selection device to select one of the current sound data or the replay sound data for transmission to the sound production apparatus.

3. A hearing aid as in claim 2, wherein the mode selection device comprises a pushbutton mechanism.

4. A hearing aid as in claim 2, wherein the sound reproduction apparatus and mode selection device are formed as an integral unit.

5. A hearing aid as in claim 2, wherein the mode selection device is separate from the sound reproduction apparatus.

6. A hearing aid as in claim 5, further comprising wireless communication apparatus for enabling communication between the sound reproduction apparatus and the mode selection device.

7. A hearing aid as in claim 1, further comprising a replay duration specification device for enabling the wearer of the hearing aid to provide one or more replay duration control signals to the sound replay apparatus that establish the replay time.

8. A hearing aid as in claim 1, further comprising means for processing analog sound data.

9. A hearing aid as in claim 1, wherein:

the sound data acquisition apparatus acquires analog sound data; and the hearing aid further comprises:

means for converting analog sound data to digital sound data;

means for processing digital sound data; and means for converting the processed digital sound data to analog sound data.

10. A hearing aid as in claim 9, wherein the means for converting analog sound data to digital sound data produces 8 bit digital signals.

11. A hearing aid as in claim 9, wherein the means for converting analog sound data to digital sound data produces 16 bit digital signals.

12. A hearing aid as in claim 1, wherein the sound data accumulation device further comprises:

a plurality of sets of an amplifier, a switch and a capacitor arranged in series in that order; and means for controlling the switch of each set, wherein:

the switches are alternately opened and closed at a specified frequency; and switches of adjacent sets are opened and closed 180 degrees out of phase with respect to each other.

13. A hearing aid as in claim 12, wherein for each pair of adjacent sets, one of the switches comprises an N-channel transistor and the other of the switches comprises a P-channel transistor.

14. A hearing aid as in claim 12, wherein the means for controlling the switches further comprises means for providing a single control signal to all of the switches to effect operation of the switches.

15. A hearing aid as in claim 12, wherein the specified frequency is greater than or equal to about 8 kHz.

16. A hearing aid as in claim 15, wherein the specified frequency is greater than or equal to about 40 kHz.

17. A hearing aid as in claim 1, wherein the sound data accumulation device further comprises a random access memory, current sound data being input to the random access memory as the current sound data is acquired, replay sound data being output from the random access memory as current sound data is being input to the random access memory if the input of the current sound data would cause the amount of sound data stored in the random access memory to exceed a replay time.

18. A hearing aid as in claim 1, wherein the sound data accumulation device is adapted to accumulate replay sound data for a replay time of greater than or equal to about 5 seconds.

19. A hearing aid as in claim 1, wherein the sound replay apparatus further comprises a second sound data selection device for selecting either the current sound data or the replay sound data to be transmitted to the sound data accumulation device for accumulation by the sound data accumulation device, the first and second sound data selection devices operating synchronously such that either current sound data is sent to both of the sound production apparatus and the sound data accumulation device, or replay sound data is sent to both of the sound production apparatus and the sound data accumulation device.

20. A hearing aid as in claim 1, wherein the sound replay apparatus further comprises means for processing the replay sound data so that the sound production apparatus produces sound corresponding to the replay sound data at a different rate than that at which the sound corresponding to the replay sound data actually occurred.

21. A hearing aid as in claim 20, wherein the means for processing the replay sound data processes the replay sound data so that the sound production apparatus produces sound corresponding to the replay sound data at a greater rate than that at which the sound corresponding to the replay sound data actually occurred.

22. A hearing aid as in claim 1, wherein the sound data accumulation device and the sound data selection device are formed as an integral unit.

23. A hearing aid as in claim 22, wherein the sound data accumulation device and the sound data selection device are formed as part of an integrated circuit.

24. A hearing aid as in claim 1, wherein the sound data acquisition apparatus comprises sound sensing apparatus adapted to sense sound in the vicinity of the hearing aid and convert the sensed sound to current sound data.

25. A hearing aid as in claim 24, wherein the sound sensing apparatus comprises a microphone.

26. A hearing aid as in claim 1, wherein the sound data acquisition apparatus comprises a receiver for receiving a signal representing sensed sound transmitted by a transmitter.

27. A hearing aid as in claim 26, wherein the transmitter is positioned at a location that is not proximate to an ear of the wearer of the hearing aid.

28. A hearing aid as in claim 1, wherein the sound production apparatus comprises a speaker.

29. A hearing aid that can acquire current sound data representing sound that occurs in the vicinity the hearing aid, produce sound in accordance with sound data, accumulate replay sound data representing sound occurring during a replay time, and select either the current sound data or the replay sound data to be used in producing sound.

30. A method for aiding hearing, comprising the steps of:

acquiring current sound data representing sound that occurs in the vicinity of a hearing aid;

producing sound in accordance with sound data;

accumulating replay sound data representing sound occurring during a replay time; and selecting either the current sound data or the replay sound data to be used in producing sound.

* * * * *